US005566565A

United States Patent [19]

Saegusa

[11] Patent Number: 5,566,565

[45] Date of Patent: Oct. 22, 1996

[54] PIPE BENDING DEVICE

[75] Inventor: Shigeru Saegusa, Sunto-gun, Japan

[73] Assignee: Usui Kokusai Sangyo Kaisha Ltd., Japan

[21] Appl. No.: 394,283

[22] Filed: Feb. 24, 1995

[30] Foreign Application Priority Data

Feb. 25, 1994 [JP] Japan ..... 6-053223

[51] Int. Cl.[6] ..... B21D 7/024

[52] U.S. Cl. ..... 72/306; 72/217

[58] Field of Search ..... 72/306, 307, 311, 72/305, 217, 388, 387

[56] References Cited

U.S. PATENT DOCUMENTS

| | | | |
|---|---|---|---|
| 2,754,881 | 7/1956 | Shaw | 72/217 |
| 4,485,658 | 12/1984 | Stewart | 72/307 |
| 4,735,075 | 4/1988 | Saegusa | 72/306 |

FOREIGN PATENT DOCUMENTS

| | | | |
|---|---|---|---|
| 3811891 | 6/1989 | Germany | 72/307 |
| 2230215 | 10/1990 | United Kingdom | 72/306 |

*Primary Examiner*—Daniel C. Crane

*Attorney, Agent, or Firm*—Anthony J. Casella; Gerald E. Hespos

[57] ABSTRACT

A pipe bending device comprising a movable unit mounted on a bed in a manner to move longitudinally of the bed. The movable unit carries a twisting motor, a bending/twisting motor, and a support plate projecting upright. A pipe retaining unit is mounted on the projecting end portion of the support plate for retaining a pipe to be worked and is rotated by a twisting plate by a predetermined angle within 360 degrees on the axis of the retained pipe. A bending roller unit is mounted on the twisting plate for bending the pipe, which is held by the twisting plate, by a predetermined angle in a plane normal to the twisting plate. A first rotation transmitting train is arranged on one side of the support plate for transmitting the rotation of the twisting motor to the twisting plate. A second rotation transmitting train is arranged on the other side of the support plate for transmitting the rotation of the bending/twisting motor to the bending roller unit.

5 Claims, 4 Drawing Sheets

PIPE BENDING DEVICE

BACKGROUND OF THE INVENTION

1. Field of the Invention

The present invention relates to a bending device mainly for bending a slender, long pipe three-dimensionally.

2. Related Art

In an ordinary bending device of this kind of the prior art, a pipe to be worked is rotated on its axis by a twisting unit holding the pipe at a proper portion, to set a bending direction, and is bend in the set position by one or two bending units which are arranged at one or two sides of the twisting unit.

Since, however, the aforementioned pipe bending device of the prior art is constructed such that the pipe is rotated on its axis by the twisting unit, the already bent leading end portion is twisted while being sequentially bent from the leading end portion, to raise a defect that a thin, longer pipe is deformed in the shape of its bent portion. Thus, the conventional pipe bending device has a tendency to be applied exclusively to a relatively large, thick and short pipe and is accordingly troubled by having its working range limited.

Since, moreover, the twisting unit is fixed in position, nothing but a remarkably short pipe can inconveniently be worked, unless the chucking position of the twisting unit relative to the pipe is changed each time it is not located at the center of the pipe.

In order to solve this problem, we have proposed a pipe bending device (as in Japanese Patent Laid-Open No. 93029/1987), which is equipped with: a chuck unit for gripping a pipe of a straight shape at its arbitrary portion; and a bending unit so disposed on at least one of the righthand and lefthand sides of the chuck unit as to move back and forth. The bending unit includes: a support member formed in its top with a pipe setting guide; a rotary member so mounted on the support member and formed in its wall with a guide groove similar to that of the support member as to rotate over the range of 360 degrees in a direction perpendicular to the axis of the pipe; and a motor-driven roller type bending unit mounted on the rotary member. The bending direction of the pipe can be set by rotating the roller type bending unit through the rotary member.

Since, however, this pipe bending device has a bending motor arranged in the roller type bending unit, this unit has its weight and capacity enlarged to increase the load upon a twisting motor for rotating the roller type bending unit and a drive motor for a movable unit for moving a moving unit. Due to a large weight (or mass), moreover, not only the accuracy is deteriorated due to the fine vibration which is generated in the upper portion of a support member, but also a stop time period is required till the attenuation of the vibration. Still moreover, the individual portions are required to have rigidity, and the moving speed and twisting rate are lowered. Furthermore, a certain limit is exerted upon the bending shape of the pipe. Furthermore, the power wires of the bending motor and the signal wires for locating the position are liable to be broken thereby to damage the device.

SUMMARY OF THE INVENTION

The present invention has been conceived in view of the aforementioned status of the pipe bending operation and has an object to provide a pipe bending device which can reduce not only the weight (or mass) and capacity of a roller type bending unit but also the load upon a twisting motor for rotating the unit and a movable unit driving motor to improve the moving and twisting speeds and to eliminate the limit to the bending shape of the pipe and the fear of the breaking of electric lines.

According to a gist of the present invention, there is provided a pipe bending device comprising: a bed; a movable unit mounted on the bed in a manner to move longitudinally of the same and carrying a twisting motor, a bending/twisting motor, and a support plate projecting upright; a pipe retaining unit mounted on the projecting end portion of the support plate for retaining a pipe to be worked; a twisting plate for rotating the pipe retaining unit by 360 degrees with a predetermined angle on the axis of the pipe which is retained by the pipe retaining unit; a bending roller unit mounted on the twisting plate for bending the pipe, which is held by the twisting plate, by a predetermined angle in a plane normal to the twisting plate; a first rotation transmitting train arranged on one side of the support plate for transmitting the rotation of the twisting motor to the twisting plate; and a second rotation transmitting train arranged on the other side of the support plate for transmitting the rotation of the bending/twisting motor to the bending roller unit. The bending roller unit includes a plurality of rotation transmitting gears mounted on the twisting plate for effecting the pipe bending operation by transmitting the rotation of the bending/twisting motor therethrough by the second rotation transmitting train. Alternatively, the bending roller unit includes a plurality of rotation transmitting gears and a rack-and-pinion mechanism mounted on the twisting plate for effecting pipe bending operation by transmitting the rotation of the bending/twisting motor therethrough by the second rotation transmitting train.

In the present invention, the movable unit is of the motor-driven type in which it is moved back and forth on the bed so that it can be brought to and stopped at the bending position of the pipe. This pipe is retained by the pipe retaining unit mounted on the support plate. In this state, the twisting motor and the bending/twisting motor carried on the movable unit are rotated to equal extents to transmit their rotations to the twisting plate through the first and second rotation transmitting trains arranged on the two sides of the support plate, so that the twisting plate is turned by the predetermined angle without any shift displacement of the bending roller unit to set the bending direction of the pipe.

When the pipe retained by the pipe retaining unit is then held on the twisting plate, the bending/twisting motor is energized. The rotation of this motor is transmitted to the bending roller unit through the second rotation transmitting train which is arranged on one side of the support plate, so that the pipe is bent by the predetermined bending angle in a plane normal to the twisting plate by the second transmitting train.

According to the present invention, the twisting motor and the pipe bending motor are mounted on not the twisting plate having the bending roller unit but the feed unit. As a result, the load upon the twisting motor can be lightened to set the pipe working shape free of any limit without increasing the moving and twisting speeds and enhancing the rigidity and to solve the breaking trouble of the electric lines.

DESCRIPTION OF THE PREFERRED EMBODIMENTS

Figure 1:
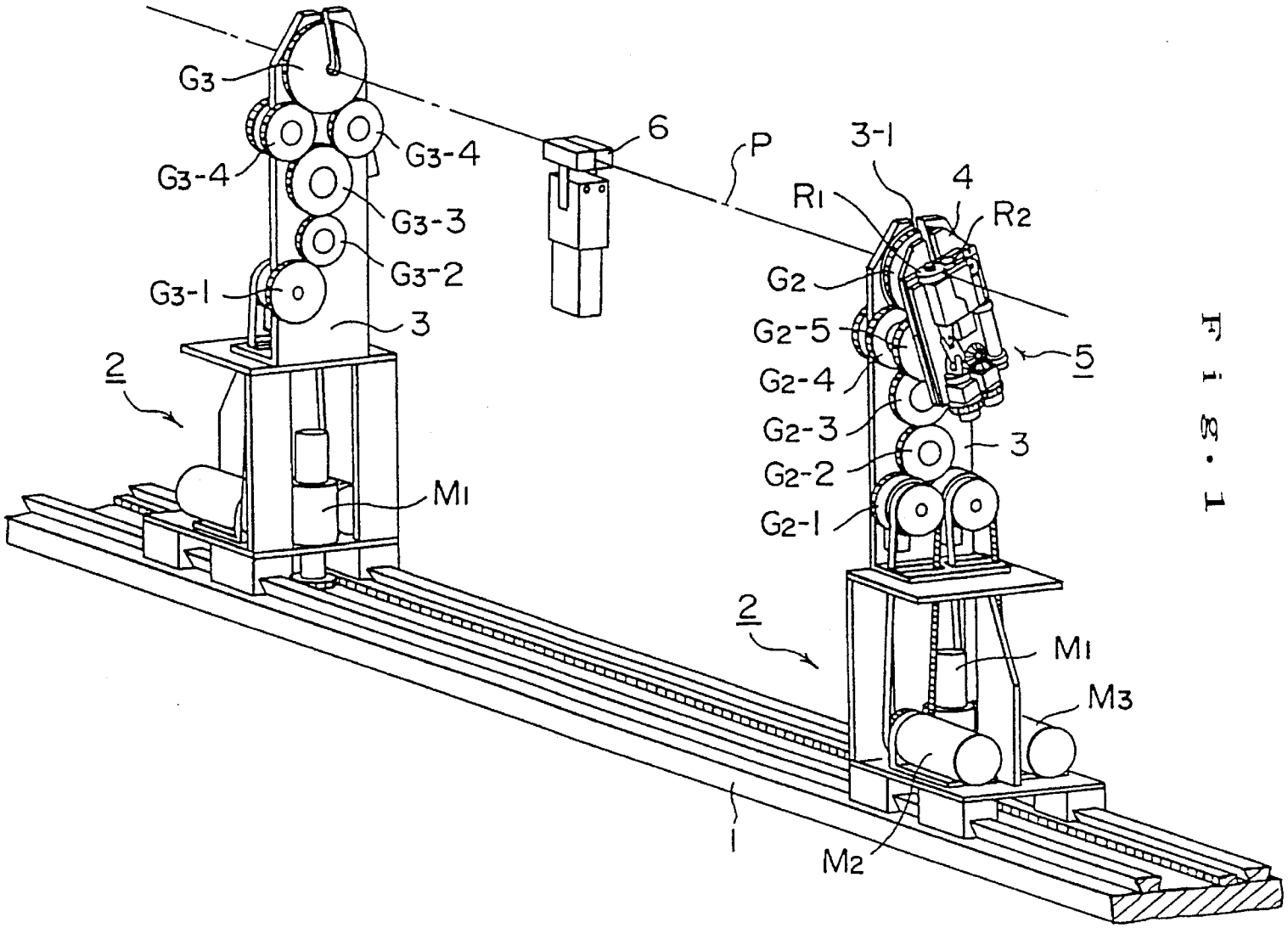
FIG. 1 is a perspective view showing the entire construction of a bending device according to the present invention.
Figure 2:
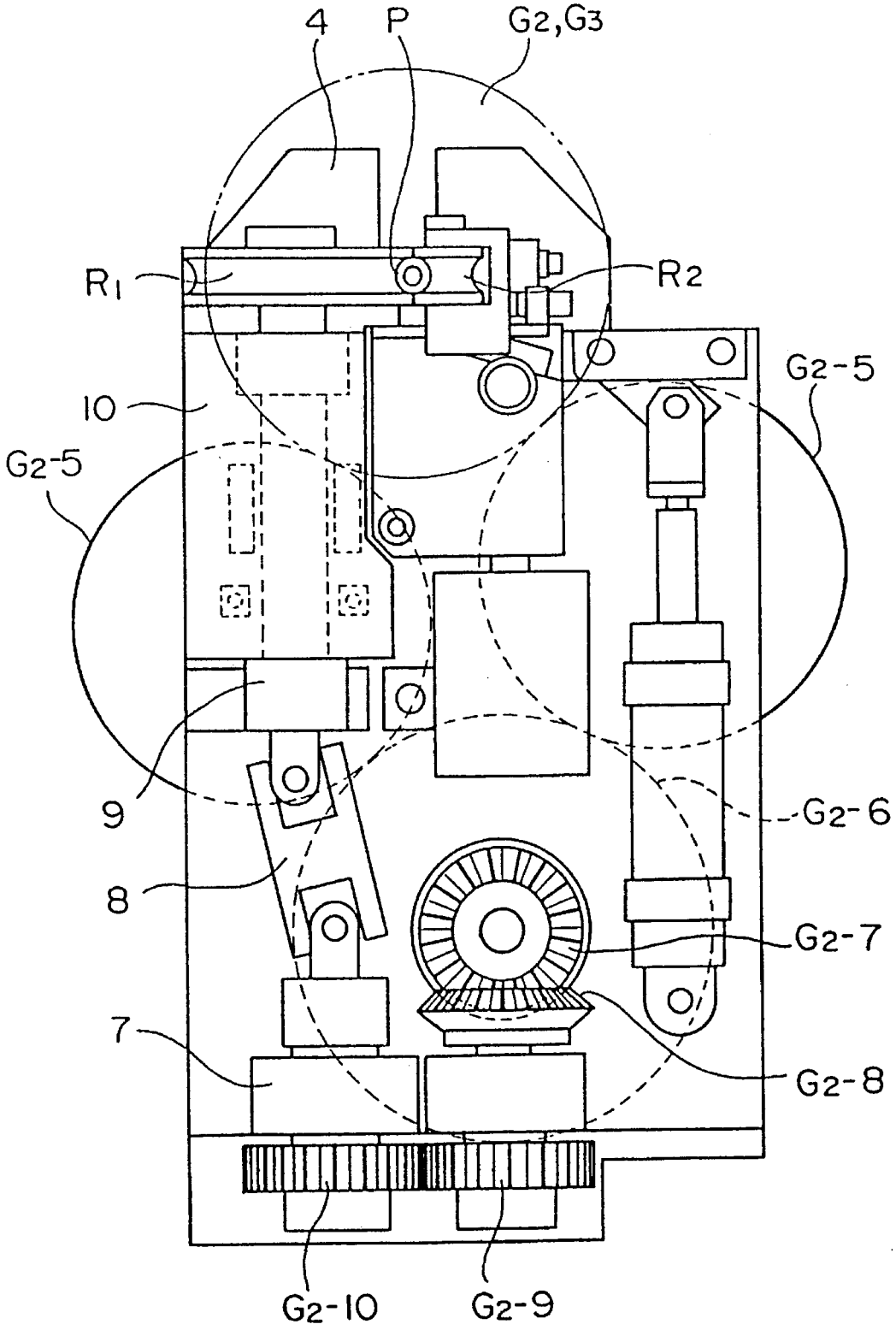
FIG. 2 is a front elevation showing a twisting plate and a bending roller unit of the same bending device in an enlarged scale.
Figure 3:
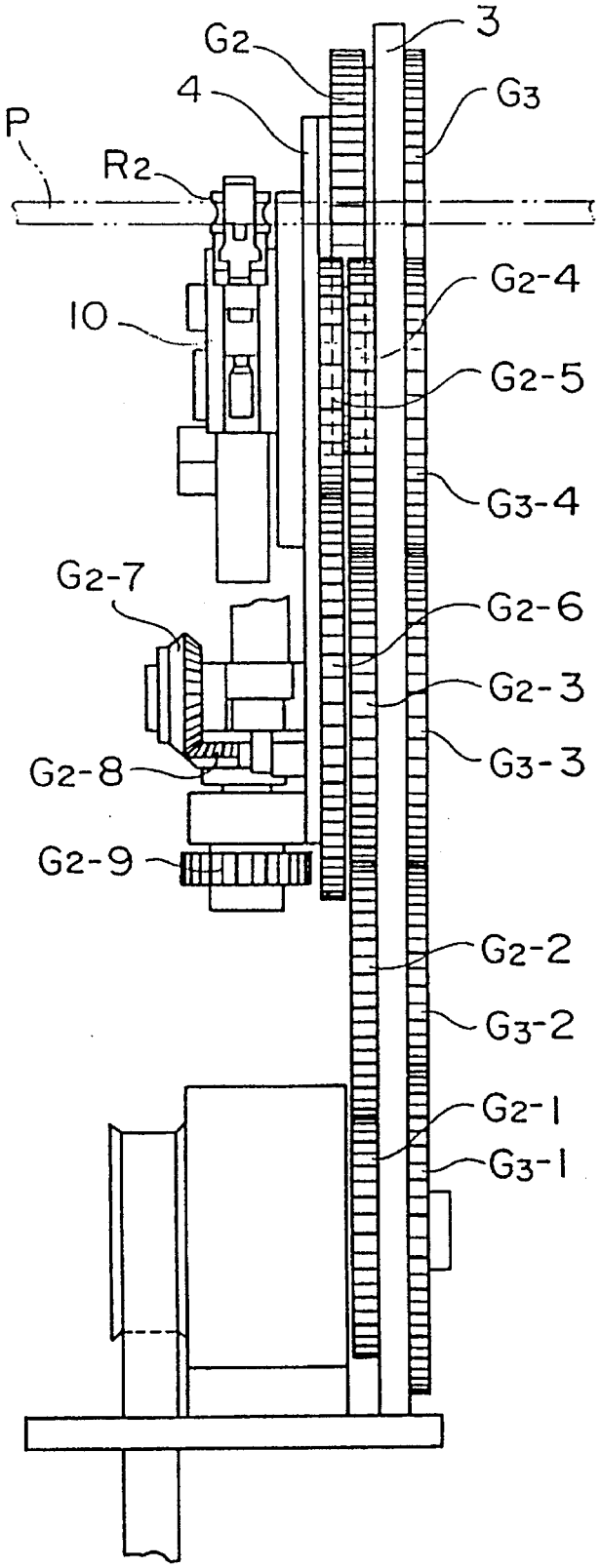
FIG. 3 is a side elevation showing the twisting plate and the bending roller unit of the same.

In FIG. 1 to 3, reference numeral 1 designates a bed; numeral 2 a movable unit; numeral 3 a support plate; numeral 4 a twisting plate; numeral 5 a bending roller unit; numeral 6 a chuck unit; numeral 7 a rotary member; numeral 8 a joint member; numeral 9 a support shaft; numeral 10 a holder; letter P a pipe to be worked; characters $M_1$ a movable unit driving motor; characters $M_2$ a bending/twisting motor; characters $M_3$ a twisting motor; characters $G_2$ a bending gear; characters G3 a twisting gear; characters $R_1$ a shaping roll; and characters $R_2$ a bending roller.

Specifically, on the upper surface of the bed 1, there are mounted a pair of righthand and lefthand movable units 2 which can move in the axial direction of the pipe P. Each movable unit 2 is moved back and forth through a rack-and-pinion mechanism by the driving motor $M_1$ which is mounted thereon. From this movable unit 2, there is projected upward the support plate 3 which has its leading end portion notched to form a pipe retaining unit 3–1 for retaining the pipe P. This pipe retaining unit 3–1 is integrated with the toothed bending gear $G_2$, twisting gear $G_3$ and twisting plate 4.

The bending/twisting motor $M_2$ and the twisting motor $M_3$, as mounted on the movable unit 2, are prime movers for setting the bending direction of the pipe P and for bending the pipe P to a predetermined direction. In the twisting mechanism, there is born on the opposed side of each support plate a gear $G_3$-1 which is rotationally driven through a pulley and a belt by the twisting motor $M_3$. Thus, the twisting gear $G_3$, as located at the upper portion of the support plate, is rotated by the gear $G_3$-1 through gears $G_3$-2 and $G_3$-3 and a pair of gears $G_3$-4.

On the twisting gear $G_3$, there is fixed coaxially with the bending gear $G_2$ through the shaft, and these bending gear $G_2$, twisting gear $G_3$ and twisting plate 4 are individually formed with notches which having their end portions arranged on line with the aforementioned pipe retaining unit 3–1. Thus, the pipe P is retained by the pipe retaining unit 3–1 and is held in this retained state by the bending gear $G_2$, the twisting gear $G_3$ and the twisting plate 4.

The bending roller unit 5 mounted on the twisting plate 4 is equipped with the stationary shaping roll $R_1$ and the bending roller $R_2$ which is made rotatable along the roll $R_1$. These shaping roll $R_1$ and bearing roller $R_2$ are equipped with calibers for clamping the pipe P individually.

In the bending/twisting mechanism, on the other hand, there is borne on the other side of each support plate 3 a gear $G_2$-1 which is rotationally driven by the bending/twisting motor $M_2$ through a pulley and a belt. The bending bear $G_2$, as located in the upper portion of the support plate 3, is rotated through rotation transmitting gears $G_2$-2 and $G_2$-3 and a pair of rotation transmitting gears $G_2$-4, which are mounted coaxially with the rotation transmitting gears $G_3$-2, $G_3$-3 and the paired rotation transmitting gears $G_3$-4 of the aforementioned twisting mechanism. The bending gear $G_2$ is in meshing engagement with a pair of rotation transmitting gears $G_2$-5 which are mounted on the back side of the twisting plate 4, and a rotation transmitting gear $G_2$-6 is also mounted on the back side of the same twisting plate 4 to mesh with the paired rotation transmitting gears $G_2$-5. Moreover, a bevel gear $G_2$-7 is mounted coaxially with the rotation transmitting gear $G_2$-6 on the front side of the twisting plate 4 and is meshed by a bevel gear $G_2$-8 which is mounted on the same side. Coaxially with this bevel gear $G_2$-8, there is mounted a rotation transmitting gear $G_2$-9, which is meshed by another rotation transmitting gear $G_2$-10 mounted on the support plate 3. The rotary member 7 made coaxial with the rotation transmitting gear $G_2$-10 is connected through the joint member 8 to the support shaft 9, and the bending roller $R_2$ is mounted on the holder 10 which is fixed on the support shaft 9. Incidentally, the bending roller $R_2$ is so carried by an actuating mechanism such as a cylinder as to come into and output abutment against the circumference of the shaping roller $R_1$.

The chuck unit 6 is positioned between the righthand and lefthand bending units to grip the pipe P which is retained by the pipe retaining unit 3–1 of the support plate 3 so that it is bent.

When the pipe P is to be bent by the bending device having the construction described above, the bending roller $R_2$ is at first brought apart from the shaping roller $R_1$ into an open state. The pipe P is gripped by the chuck unit 6 at its central portion apart from its one end portion to be bent, and its one end portion is threaded into the individual notches of the pipe retaining unit 3–1, the bending gear $G_2$, the twisting gear $G_3$ and the twisting plate 4 of the support plate 3, all of which are arranged in phase. Subsequently, the position of the pipe P the closest to its one end is aligned to the caliber positions of the shaping roll $R_1$ and the bending roller $R_2$, and this bending roller $R_1$ is moved toward the shaping roll $R_1$ to hold the pipe P.

In this state, the bending/twisting motor $M_2$ and the twisting motor $M_3$ are energized to rotate the gears $G_2$-1 and $G_3$-1 and accordingly the bending gear $G_2$ through the rotation transmitting gears $G_2$-2, $G_2$-3 and $G_2$-4 and the twisting gear $G_3$ through the rotation transmitting gears $G_3$-2, $G_3$-3 and $G_3$-4. As the bending gear $G_2$ and the twisting gear $G_3$ rotate, the twisting plate 4 fixed to the twisting gear $G_3$ is turned to turn the pipe P, which is held by the shaping roll $R_1$ and the bending roller $R_2$, by a predetermined twisting angle on the axis thereof, thereby to set the bending direction of the pipe P.

Here, with the twisting motor $M_3$, the gear $G_3$-1, the rotation transmitting gears $G_3$-2, $G_3$-3 and $G_3$-4 and the twisting gear $G_3$ being fixed, only the bending/twisting motor $M_2$ is energized to rotate the uppermost bending gear $G_2$ thereby to sequentially rotate the rotation transmitting gears $G_2$-5 and $G_2$-6 which are mounted on the back side of the twisting plate 4. As the rotation transmitting gear $G_2$-6 rotates, the bevel gear $G_2$-7 made coaxial with it rotates so that the rotations are transmitted to the support shaft 9 through the bevel gear $G_2$-8, the rotation transmitting gears $G_2$-9 and $G_2$-10, the rotary member 7 and the joint member 8. When the support shaft 9 thus rotates, the holder 10 fixed on the support shaft 9 also rotates so that the bending roller $R_2$ rotates by the predetermined bending angle on the axis of the shaping roll $R_1$ to bend the pipe P.

At the end of this bending operation at the first bending position, the bending/twisting motor $M_2$ is reversed while the pipe P being gripped by the chuck unit 6, to return the bending roller $R_2$ to the initial position. Then, the movable unit driving motor $M_1$ is started to move the movable unit 2 from the one end of the pipe P to the vicinity of the next position to be worked. After this, the next worked position is subjected to a bending treatment by a similar operation, and the pipe P is sequentially likewise subjected to the predetermined bending treatment. When these bending treatments are ended, the pipe P is released from the chuck unit 6.

Incidentally, the foregoing embodiment has been described in connection with the bending operation at one end of the pipe. Since, however, the present invention is equipped with the paired righthand and lefthand bending devices across the chuck unit 6, the pipe P gripped at its central portion by the chuck unit 6 can be bent simultaneously at its two ends, to shorten the time period required for the bending operation. If this working efficiency is ignored, however, one bending device can also be arranged for one chuck unit.

According to another embodiment of the present invention, moreover, the mechanism for transmitting the rotating force to the aforementioned support shaft 9 can be exemplified by a rack-and-pinion mechanism in place of the aforementioned bevel gear mechanism.

Figure 4:
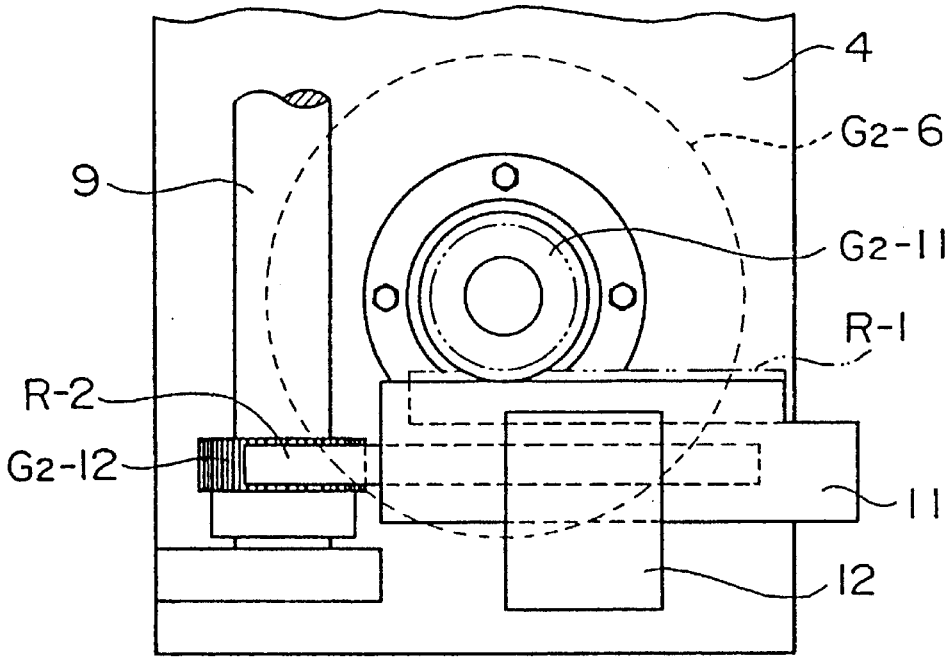
FIG. 4 is a front elevation showing only an essential portion of another embodiment of a mechanism for transmitting rotations to the bending roller unit.
Figure 5:
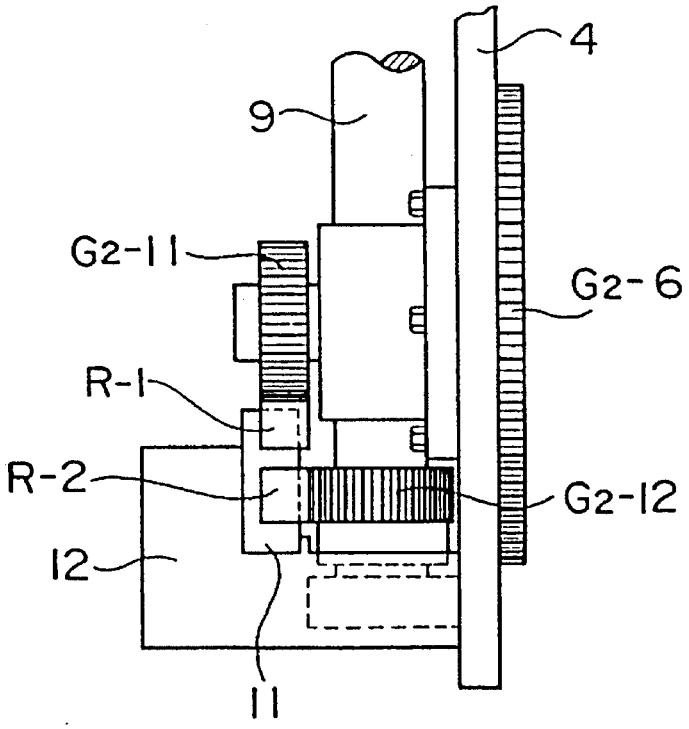
FIG. 5 is a side elevation showing the rotation transmitting mechanism of the same.

FIGS. 4 and 5 shows one example of the rack-and-pinion mechanism. A pinion $G_2$-11 is mounted coaxially with the rotation transmitting gear $G_2$-6 on the front side of the twisting plate 4 and is made to mesh with a rack R-1, which is slidably mounted on the same side of the twisting plate 4, and a rack R-2 is integrated in parallel with the rack R-1 and is made to mesh with a pinion $G_2$-12 which is mounted on the support shaft 9. Thus, the rotation of the rotation of the rotation transmitting gear $G_2$-6 is transmitted to the support shaft 9 through the two sets of rack-and-pinion mechanisms thus constructed. The slide mechanism of the racks R-1 and R-2 in the rack-and-pinion mechanism is constructed such that the two racks R-1 and R-2 are carried on a slider 11 and such that the slider 11 is enabled to slide through teeth in a slide guide 12 mounted on the twisting plate 4.

Specifically of the case of this rack-and-pinion mechanism, as the rotation transmitting gear $G_2$-6 rotates, the pinion $G_2$-11 made coaxial with that gear rotates to move the slider 11 through the rack R-1. Simultaneously with this, the rotation is transmitted to the support shaft 9 through the rack R-2 and the pinion $G_2$-12 so that the pipe P is bent.

Incidentally, in the bending device of the present invention, the pipe P can be fully automatically bent by inputting the individual bending positions of the pipe P and the twisting angle and bending angle at each bending position in advance to the (not-shown) automatic control unit.

The present invention thus constructed achieves the effects, as follows.

(1) Since the bending unit has its inertial mass reduced, the bending device can have its deflection reduced to improve the bending accuracy and elongate the lifetime thereby to raise the moving speed and twisting rate and shorten the tack time.

(2) Since the bending roller unit is not equipped with a regulating member such as a motor for regulating the bending operation of the pipe, all bending operations can be accomplished by the small-sized and lightened bending roller unit.

(3) Since the bending roller unit is rotated by the bending/twisting motor and the twisting motor, the twisting motor can have its capacity reduced to reduce the entire size.

(4) Since the bending roller unit is not equipped with a motor for the bending operation, the trouble such as the breaking of electric wires is not caused in the least by the turning motion of the bending roller unit.

(5) No deformation occurs in the bent portion at the leading end of the pipe so that a variety of bending operations can be accomplished highly accurately.

What is claimed is:

1. A pipe bending device for bending a pipe having a longitudinal axis, said device comprising: an elongate bed; a movable unit mounted on said bed in a manner to move longitudinally of the same, a support plate on said movable unit and projecting away from said bed; a twisting plate rotatably mounted on said support plate for holding and rotating said pipe by a predetermined angle on the axis of the pipe for setting a selected bend direction for the pipe; a bending roller unit mounted on said twisting plate for bending the pipe, which is held by said twisting plate, by a predetermined bending angle in a plane normal to said twisting plate; a first rotation transmitting train on said support plate for transmitting rotation to said twisting plate for setting the selected bend direction; a second rotation transmitting train on said support plate for transmitting rotation to said bending roller unit for bending said pipe by said predetermined bending angle; a twisting motor on said movable unit for operating said first rotation transmitting train to rotate said twisting plate for setting said selected bend direction for said pipe; and a bending/twisting motor for operating said second rotation transmitting train to rotate said bending roller unit for bending said pipe by said predetermined angle.

2. A pipe bending device according to claim 1, wherein said bending roller unit includes a plurality of rotation transmitting gears mounted on said twisting plate for effecting the pipe bending operation by transmitting the rotation of said bending/twisting motor therethrough by said second rotation transmitting train.

3. A pipe bending device according to claim 1, wherein said bending roller unit includes a plurality of rotation transmitting gears and a rack-and-pinion mechanism mounted on said twisting plate for effecting pipe bending operation by transmitting the rotation of said bending/twisting motor therethrough by said second rotation transmitting train.

4. A pipe bending device according to claim 1, further comprising a chuck unit in proximity to said bed for gripping and supporting said pipe relative to said bed, wherein said movable unit is arranged on at least one side of said chuck unit.

5. A pipe bending device according to claim 1, further comprising a chuck unit rigidly mounted in proximity to said bed for gripping and supporting a central portion of said pipe relative to said bed, wherein said movable unit is a first movable unit, and wherein said bending device further includes a second movable unit substantially identical to said first movable unit, said chuck unit being disposed between said first and second movable units.

* * * * *